US009021725B2

(12) United States Patent
Stalker et al.

(10) Patent No.: US 9,021,725 B2
(45) Date of Patent: May 5, 2015

(54) BOOM SHEAVE WITH TUBULAR REINFORCING MEMBERS

(75) Inventors: Glenn H. Stalker, Glendale, WI (US); William R. Powers, Mukwonago, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 96 days.

(21) Appl. No.: 13/363,015

(22) Filed: Jan. 31, 2012

(65) Prior Publication Data

US 2012/0195728 A1 Aug. 2, 2012

Related U.S. Application Data

(60) Provisional application No. 61/438,472, filed on Feb. 1, 2011.

(51) Int. Cl.

| | |
|---|---|
| ***E02F 3/58*** | (2006.01) |
| ***E02F 9/20*** | (2006.01) |
| ***E02F 3/46*** | (2006.01) |

(52) U.S. Cl.
CPC ..... *E02F 9/2016* (2013.01); *E02F 3/46* (2013.01)

(58) Field of Classification Search
USPC ..... 474/197, 168, 176; 37/394–397, 37/398–401; 254/902
See application file for complete search history.

(56) References Cited

U.S. PATENT DOCUMENTS

| | | | | | |
|---|---|---|---|---|---|
| 562,073 | A | * | 6/1896 | Foote | 474/197 |
| 1,400,142 | A | * | 12/1921 | Cyr | 211/119.09 |
| 1,448,989 | A | * | 3/1923 | Anderson | 384/382 |
| 1,600,098 | A | * | 9/1926 | Crumley | 474/197 |
| 1,722,599 | A | * | 7/1929 | Test | 474/96 |
| 1,799,935 | A | * | 4/1931 | Taylor | 384/417 |
| 1,952,884 | A | * | 3/1934 | Nichols et al. | 474/8 |
| 1,976,025 | A | * | 10/1934 | Knudsen | 474/168 |
| 1,983,844 | A | * | 12/1934 | Evenburgh | 474/168 |
| 2,198,787 | A | * | 4/1940 | Nystrom | 474/168 |
| 2,922,310 | A | * | 1/1960 | Anderson | 474/175 |
| 3,680,840 | A | | 8/1972 | Pech | |
| 4,065,044 | A | * | 12/1977 | Painter et al. | 226/188 |
| D252,750 | S | * | 8/1979 | Painter et al. | D14/260 |
| 4,417,718 | A | * | 11/1983 | Niskin | 254/394 |
| D306,134 | S | * | 2/1990 | Harken et al. | D8/360 |
| 6,142,450 | A | * | 11/2000 | Hagstrom | 254/390 |
| D450,565 | S | * | 11/2001 | DiBianca | D8/360 |
| 6,480,773 | B1 | | 11/2002 | Hilgart | |
| 6,881,166 | B1 | * | 4/2005 | Burkhardt et al. | 474/176 |
| 7,024,806 | B2 | | 4/2006 | Suzik et al. | |
| 2001/0039985 | A1 | * | 11/2001 | Johnson | 152/70 |
| 2007/0266601 | A1 | | 11/2007 | Claxton | |
| 2011/0094116 | A1 | * | 4/2011 | Diefenderfer | 33/286 |
| 2012/0220401 | A1 | * | 8/2012 | Kida | 474/152 |

OTHER PUBLICATIONS

Machining Gear 4100BOSS/4100XPB (DWG #R56638), P&H, Apr. 23, 2005.

AU2012200469 Patent Examination Report No. 1 dated Aug. 19, 2013 (3 pages).

* cited by examiner

*Primary Examiner* — Matthew D Troutman
(74) *Attorney, Agent, or Firm* — Michael Best & Friedrich LLP

(57) ABSTRACT

A sheave includes a hub defining an axis, a rim defining at least one circumferentially extending groove, and two plates oriented substantially perpendicular to the axis. Each plate is connected to the hub and to the rim, and a plurality of reinforcing tubular members extend between the plates.

16 Claims, 4 Drawing Sheets

BOOM SHEAVE WITH TUBULAR REINFORCING MEMBERS

CROSS-REFERENCE TO RELATED APPLICATIONS

This application claims the benefit of and priority to U.S. Provisional patent application No. 61/438,472, filed Feb. 1, 2011, the entire contents of which are hereby incorporated by reference herein.

BACKGROUND

In the mining field, and in other fields in which large volumes of materials must be collected and removed from a work site, it is typical to employ a power shovel including a large dipper for shoveling the materials from the work site. After filling the dipper with material, the shovel swings the dipper to the side to dump the material into a material handling unit, such as a dump truck or a local handling unit (e.g., crusher, sizer, or conveyor). Generally, the shovels used in the industry include hydraulic shovels and electric rope shovels. Electric rope shovels typically include a shovel boom, the end of which rotatably supports a sheave or pulley. A hoist rope extends around the sheave or pulley and is connected to the shovel dipper to raise and lower the dipper, thereby producing an efficient digging motion to excavate the bank of material. Conventional electric rope shovels include a sheave that incorporates radially-extending, plate-type reinforcing members (also called stiffeners) between the plates of the sheave and cutouts in the plates between the reinforcing members.

SUMMARY

In one embodiment, a sheave includes a hub defining an axis, a rim defining at least one circumferentially extending groove, and two plates oriented substantially perpendicular to the axis. Each plate is connected to the hub and to the rim, and a plurality of reinforcing tubular members extend between the plates.

In another embodiment an electric shovel includes a base and a motor driving a pulling mechanism. A boom extends from the base and has a first end attached to the base and a second end remote from the base. A boom handle is pivotally mounted on the boom and a dipper is attached to an end of the boom handle. A sheave is rotatably attached to the second end of the boom and includes a hub rotatably coupled to the boom and defining an axis, a rim having at least one circumferentially extending groove, and two spaced apart and parallel plates. Each plate is connected to the hub and to the rim, and a plurality of reinforcing tubular members extend between the plates.

Other aspects of the invention will become apparent by consideration of the detailed description and accompanying drawings.

Figure 1:
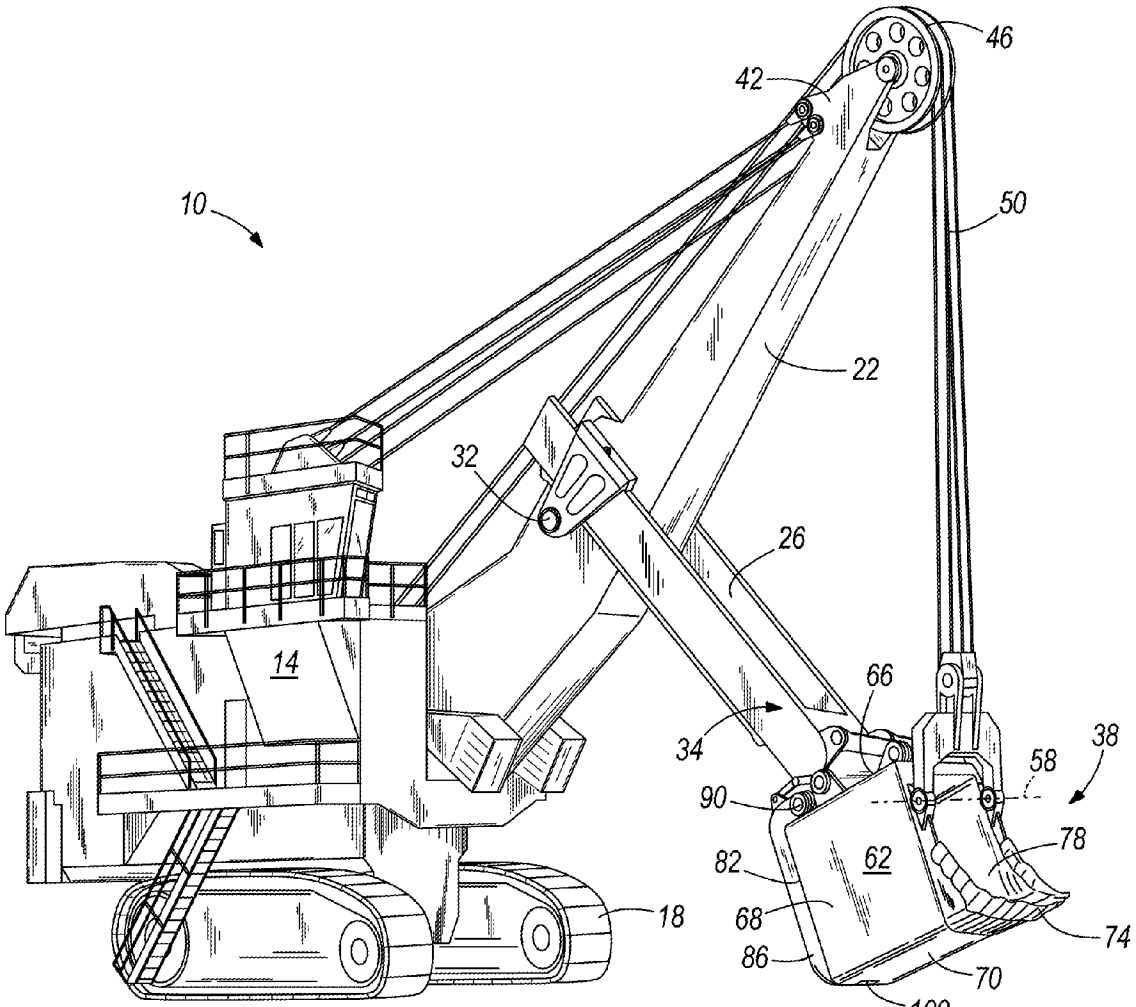
FIG. 1 is a side elevational view of a power shovel embodying the present invention.

It is to be understood that the invention is not limited in its application to the details of the construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

DETAILED DESCRIPTION

FIG. 1 illustrates an electric rope power shovel 10 having a sheave 46 according to an embodiment of the invention. Although the improved sheave 46 is described with respect to an electric rope shovel, the sheave 46 can also be used with other types of shovels or machines (e.g., a crane). In one embodiment, the shovel 10 comprises a frame 14 (also called a base) supported for movement over the ground. Specifically, the frame 14 is a revolvable upper frame mounted on a mobile base including crawler tracks 18. A fixed boom 22 extends upwardly and outwardly from the frame 14. One end of the boom 22 is attached to the frame 14 and another end of the boom 22 is remote from the frame 14. In some embodiments, the boom 22 is curved and has "banana" or a "V" shape. In other embodiments, the boom can be straight or have different shapes. In one embodiment, the boom 22 comprises a one piece construction combining a first portion and a second portion of the boom. In other embodiments, the boom 22 comprises two pieces, where the two portions of the boom 22 are securely attached to one another via welding, pin joints, fasteners, or any other suitable attachment mechanisms.

A dipper handle 26 is mounted on the boom 22 for movement about a rack and pinion or crowd drive mechanism (not shown) for pivotal movement relative to the boom 22 about a generally horizontal dipper handle axis 32, and for translational (non-pivotable) movement relative to the boom 22. The dipper handle 26 has a forward end 34, and a dipper 38 is mounted on the forward end 34 of the dipper handle 26. An outer end 42 of the boom 22 has thereon the sheave 46, and a hoist cable or rope 50 extends over the sheave 46 from a winch drum (not shown) mounted on the frame 14 and is connected to the dipper 38 for pivotal movement relative thereto about a horizontal pivot axis 58. The winch drum is driven by at least one electric motor (not shown) that incorporates a transmission unit (not shown). As the winch drum rotates, the hoist rope 50 is paid out to lower the dipper 38 or pulled in to raise the dipper 38. The dipper handle 26 is also rigidly attached to the dipper 38. The dipper handle 26 is slidably supported in a saddle block, and the saddle block is pivotally mounted to the boom 22 at the pivot point. The dipper handle 26 includes a rack tooth formation thereon which engages a drive pinion mounted in the saddle block.

The dipper 38 is generally of a box shape having a body 62 which includes a back wall 66, opposite side walls 68 extending forwardly from and substantially perpendicular to the back wall 66, and a front wall 70 which is generally parallel to the back wall 66. In other embodiments (not shown), other dipper body shapes can be used. Digging teeth 74 extend outwardly from an upper end of the front wall 70. The main body or dipper body 62 defines a material receiving opening 78 and a material discharging opening 82. The dipper 38 further includes a dipper door 86 pivotally connected to the back wall 66 adjacent the lower end thereof about a dipper door axis 90. The dipper door 86 is movable between opened and closed positions, as will be further described below. The back wall 66 of the dipper 38 is connected to the forward end 34 of the dipper handle 26. The back wall 66 (and thus the dipper 38) is rigidly connected to the dipper handle 26.

Figure 2:
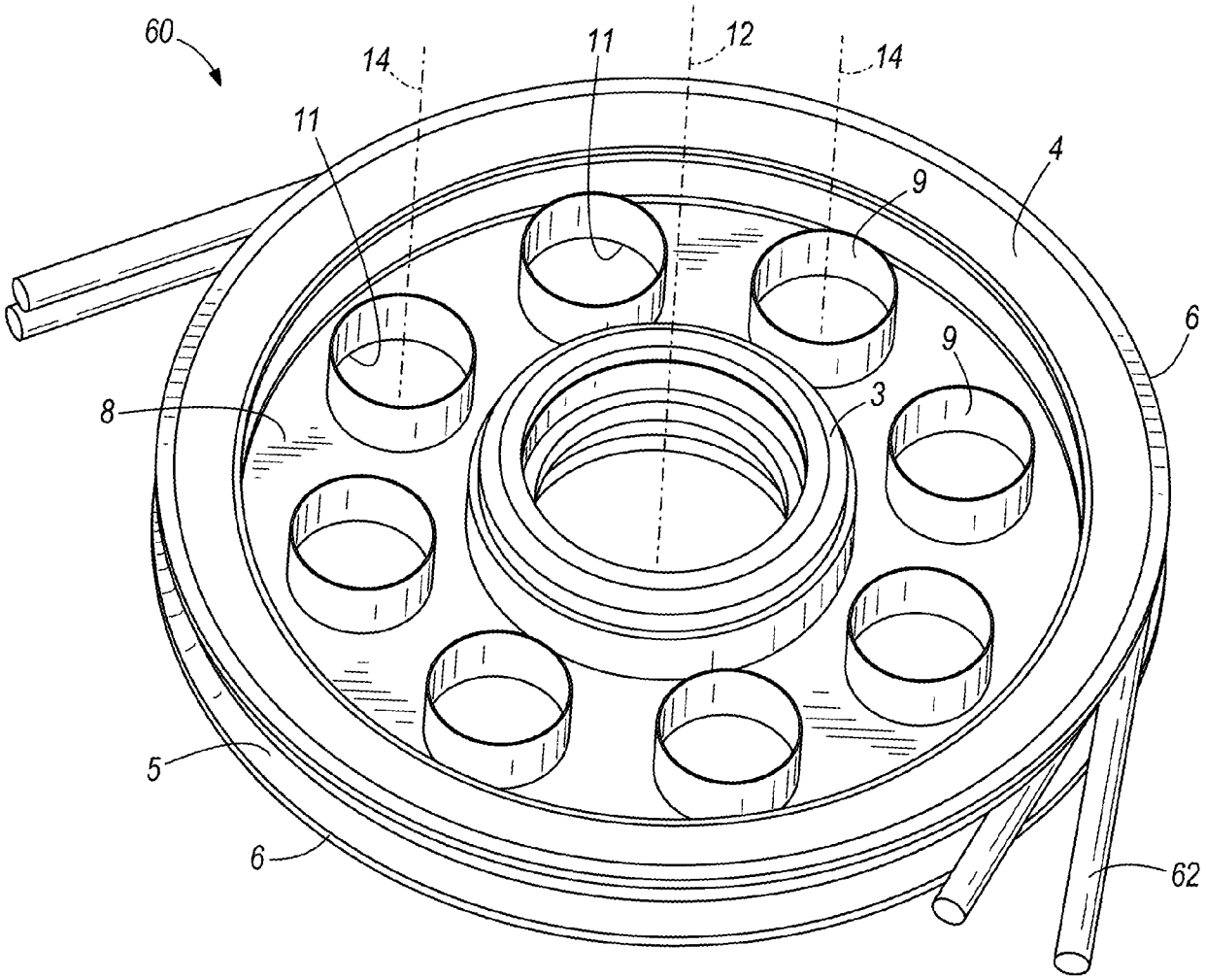
FIG. 2 is a perspective view of a boom sheave of the shovel shown in FIG. 1, with a portion removed to expose the interior structure.
Figure 3:
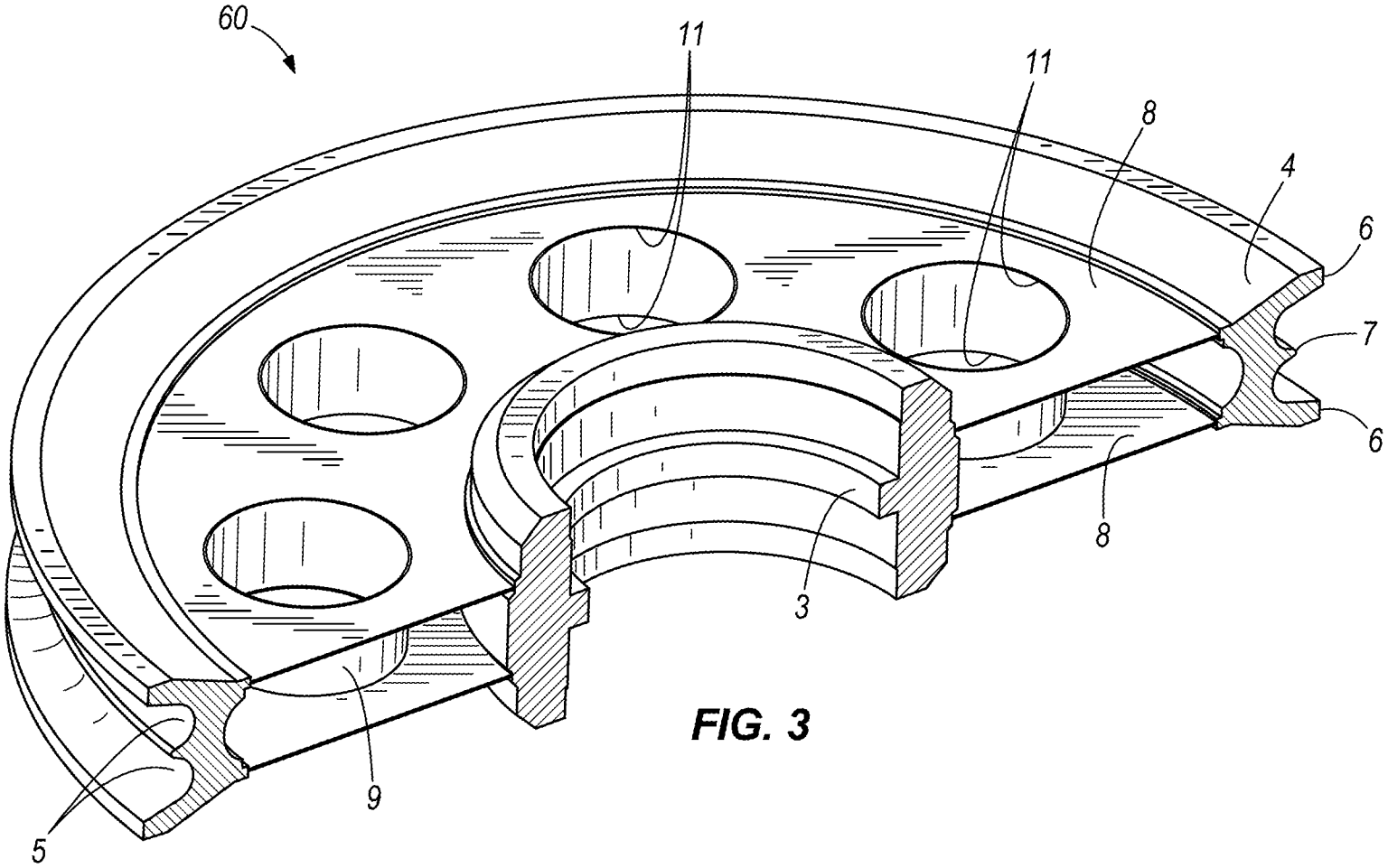
FIG. 3 is a section view of the boom sheave of FIG. 2.

Referring now to FIGS. 2 and 3, which illustrate the sheave 46 in further detail, the sheave 46 includes a substantially circular center hub 3 defining a central axis 12 and a substantially circular rim 4 surrounding and substantially concentric with the hub 3. The rim 4 defines at least one outwardly facing and circumferentially extending groove 5. In the embodiment illustrated in FIGS. 2 and 3, the rim 4 defines two grooves 5. The rim 4 includes two outer circumferential edges 6 and a middle circumferential edge 7 that separates the two grooves 5. The grooves 5 are adapted to accept the hoist rope 62, which rotates the sheave 46 and moves the dipper 55 as discussed above. The grooves 5, the outer circumferential edges 6 and the middle edge 7 cooperate to securely support the hoist rope 62.

Figure 4:
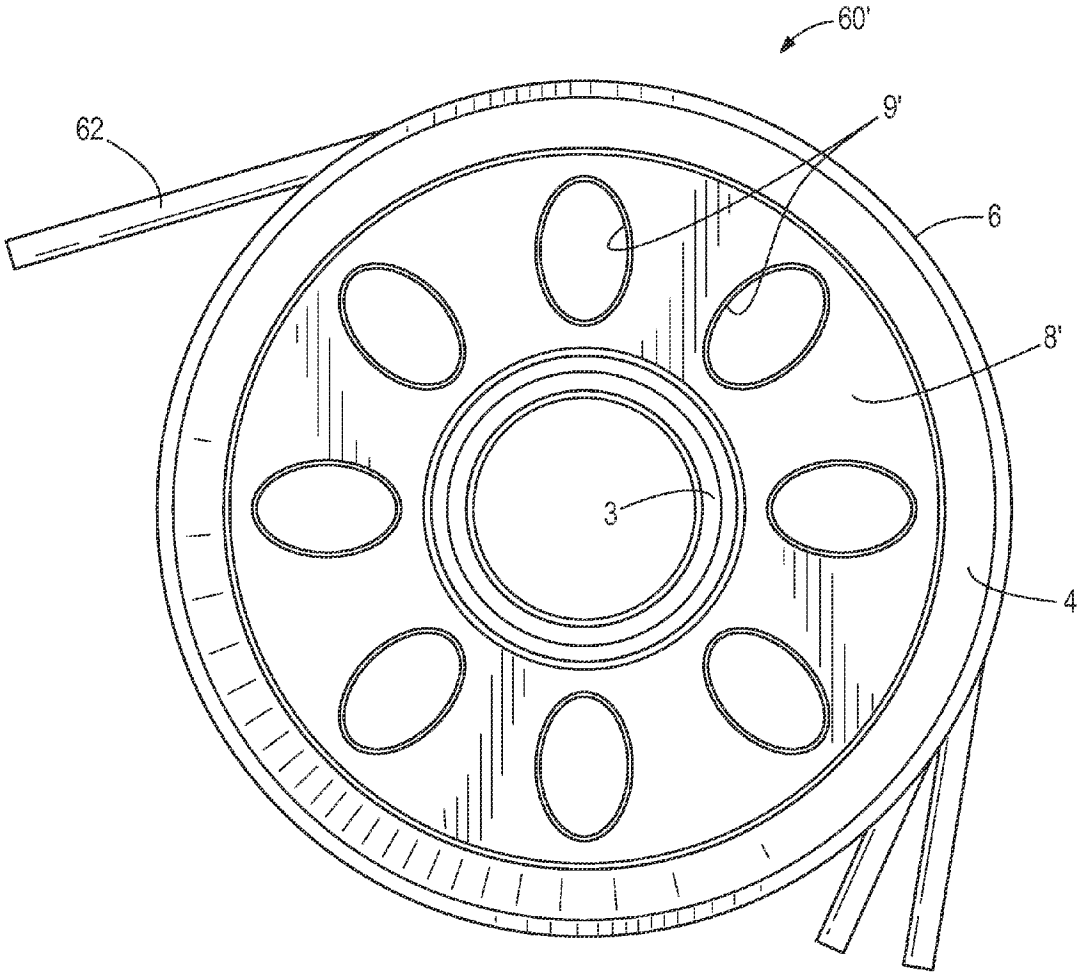
FIG. 4 is a side view of a boom sheave according to another embodiment.

The sheave 46 also includes two substantially parallel web plates 8 extending between the hub 3 and the rim 4 of the sheave 46. In FIG. 2, the top web plate 8 has been removed to reveal the internal structure of the sheave 46. The plates 8 are spaced apart from one another and are connected to the hub 3 and to the rim 4 using a suitable method such as welding. Alternative embodiments may also or alternatively rely on fasteners to couple the plates 8 to the hub 3 and the rim 4. A plurality of spaced apart tubular reinforcing members 9 extend between the two plates 8 and are generally circumferentially spaced around the hub 3. In the illustrated construction, each tubular member 9 defines an axis 14 that is substantially parallel to the central axis 12. The tubular members 9 can be constructed from metal and can be welded or otherwise joined to the plates 8. In the embodiment show in FIGS. 2 and 3, the tubular members 9 have a circular cross-section. In alternative embodiments, the tubular members 9 can have a different cross-section (e.g., square, elliptical (FIG. 4), and the like). Each web plate 8 defines a plurality of circumferentially spaced openings 11 that are substantially aligned with and shaped to correspond to the size and shape of the tubular members 9. The arrangement of the openings 11 and the tubular members 9 is such that, when viewed from the side, the tubular members 9 define side-walls of a series of openings that extend completely through the sheave 46.

In the illustrated embodiment the tubular members 9 are substantially evenly spaced in a circle around the hub 3. In alternative embodiments, the tubular members can be positioned in a different configuration. The length of the tubular members 9 can depend upon the size of the sheave 46. In general, the distance between the plates 8 is substantially equal to the length of the tubular members 9. In the illustrated configuration, the tubular members are arranged such that a straight line drawn radially outwardly from the central axis 12 in any direction will intersect only one of the tubular members 9.

Various features and advantages of the invention are set forth in the following claims.

What is claimed is:

1. A mining shovel including a base and a motor driving a pulling mechanism, the mining shovel comprising:

a boom extending from the base, the boom having a first end attached to the base, and a second end remote from the base;

a boom handle pivotally mounted on the boom;

a dipper attached to an end of the boom handle;

a hoist rope extending over the second end of the boom and supporting the end of the boom handle, the hoist rope configured to be driven by the motor; and a sheave rotatably attached to the second end of the boom, the sheave including a hub rotatably coupled to the boom and defining an axis, two parallel plates defining a space therebetween, each plate including an outer perimeter and an inner edge connected to the hub, a unitary rim member having an inner surface secured to the outer perimeter of both plates and defining multiple circumferentially extending grooves for receiving and guiding the hoist rope over the second end of the boom, and a plurality of reinforcing tubular members extending between the plates, each tubular member extending through both plates and defining a hollow space extending through both plates.

2. The mining shovel of claim 1, wherein the boom handle further includes a connecting mechanism engaging the hoist rope and connecting at least one of the dipper and the boom handle with the sheave.

3. The mining shovel of claim 1, wherein each tubular member is coupled to both of the plates.

4. The mining shovel of claim 1, wherein the tubular members have a circular cross-section.

5. The mining shovel of claim 1, wherein a distance between the plates is equal to a length of the tubular members.

6. The mining shovel of claim 1, wherein the tubular members extend in a direction perpendicular to the plates.

7. The mining shovel of claim 1, wherein each plate defines a plurality of openings, wherein the openings are substantially axially aligned, and wherein a shape of the openings corresponds to a cross-section of the tubular members.

8. The mining shovel of claim 7, wherein the tubular members are aligned with the openings.

9. The mining shovel of claim 1, wherein at least one of the circumferentially extending grooves radially outwardly.

10. The mining shovel of claim 1, wherein the tubular members each define a central axis, and wherein the central axis of each tubular member is substantially parallel to the axis of the hub.

11. The mining shovel of claim 1, wherein the unitary rim member includes a pair of outer circumferential edges and an intermediate circumferential edge dividing the grooves, wherein the surface extending between the outer circumferential edges is continuous.

12. The mining shovel of claim 11, wherein the pair of outer circumferential edges extend out radially further than the intermediate circumferential edge dividing the grooves.

13. The mining shovel of claim 1, wherein the outer perimeter of each parallel plate is secured to the inner surface of the unitary rim member by welding.

14. The mining shovel of claim 1, wherein each tubular member includes a first end welded to one of the parallel plates and a second end welded to the other of the parallel plates.

15. The mining shovel of claim 1, wherein the inner edge of each plate is welded to an outer surface of the hub.

16. The mining shovel of claim 1, wherein an enclosed space is defined between the parallel plates, the hub, the inner surface of the unitary rim member, and the tubular members.

* * * * *

UNITED STATES PATENT AND TRADEMARK OFFICE

CERTIFICATE OF CORRECTION

PATENT NO. : 9,021,725 B2
APPLICATION NO. : 13/363015
DATED : May 5, 2015
INVENTOR(S) : Glenn H. Stalker et al.

It is certified that error appears in the above-identified patent and that said Letters Patent is hereby corrected as shown below:

In the Claims

Col. 4, Line 37, Claim 9 reads: "circumferentially extending grooves radially outwardly" should be changed to: circumferentially extending grooves --opens-- radially outwardly.

Signed and Sealed this
Twenty-second Day of September, 2015

Michelle K. Lee

Michelle K. Lee
*Director of the United States Patent and Trademark Office*